US008454327B2

(12) United States Patent
Hirata et al.

(10) Patent No.: US 8,454,327 B2
(45) Date of Patent: Jun. 4, 2013

(54) PIEZOELECTRIC MICROPUMP

(75) Inventors: Atsuhiko Hirata, Yasu (JP); Gaku Kamitani, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 275 days.

(21) Appl. No.: 12/234,858

(22) Filed: Sep. 22, 2008

(65) Prior Publication Data

US 2009/0010779 A1 Jan. 8, 2009

Related U.S. Application Data

(63) Continuation of application No. PCT/JP2007/052323, filed on Feb. 9, 2007.

(30) Foreign Application Priority Data

Mar. 22, 2006 (JP) ..... 2006-079424

(51) Int. Cl.
*F04B 17/00* (2006.01)
*F04B 45/047* (2006.01)
*F04B 43/04* (2006.01)

(52) U.S. Cl.
USPC ..... 417/413.2

(58) Field of Classification Search
USPC ..... 417/322, 413.2, 50
See application file for complete search history.

(56) References Cited

U.S. PATENT DOCUMENTS 2,928,409 A * 3/1960 Johnson et al. ..... 137/82
3,107,630 A * 10/1963 Johnson et al. ..... 417/322
4,430,529 A * 2/1984 Nakagawa et al. ..... 381/190
6,565,331 B1 * 5/2003 Takeuchi et al. ..... 417/322
2003/0017063 A1 * 1/2003 Komatsu et al. ..... 417/413.2
2004/0001767 A1 1/2004 Peters et al.
2004/0202558 A1 * 10/2004 Fong et al. ..... 417/413.2
2005/0019180 A1 1/2005 Seto et al.
2005/0244288 A1 11/2005 O'Neill
2009/0232680 A1 * 9/2009 Kitahara et al. ..... 417/413.2

FOREIGN PATENT DOCUMENTS

CN 1573102 A 2/2005
JP 1-67479 U 4/1989
JP 3-8680 U 1/1991
JP 2001-065461 A 3/2001
JP 2003-214349 A 7/2003

OTHER PUBLICATIONS

Official Communication issued in corresponding Chinese Patent Application No. 2007800141332, mailed on Jan. 8, 2010.

(Continued)

*Primary Examiner* — Charles Freay
*Assistant Examiner* — Philip Stimpert
(74) *Attorney, Agent, or Firm* — Keating & Bennett, LLP

(57) ABSTRACT

A piezoelectric micropump in which a pump chamber is isolated by a diaphragm. A piezoelectric element is disposed on a back surface of the diaphragm, and the diaphragm is deformed by bending deformation of the piezoelectric element to change the volume of the pump chamber and transport fluid in the pump chamber. A support member for supporting a back surface of the piezoelectric element is provided so that the support member inhibits bending of a peripheral portion of the diaphragm in a reverse direction. The support member thus prevents the piezoelectric element from being floated. Accordingly, the displacement of the piezoelectric element can be reliably transmitted as the change in volume of the pump chamber, thereby enhancing the fluid transportation performance.

6 Claims, 6 Drawing Sheets

OTHER PUBLICATIONS

Official Communication issued in corresponding German Patent Application No. 11 2007 000 669.2, mailed on Jul. 15, 2010.
Official Communication issued in corresponding Chinese Patent Application No. 200780014133.2, mailed on Aug. 23, 2009.
Official Communication issued in International Patent Application No. PCT/JP2007/052323, mailed on May 1, 2007.
English translation of Official Communication issued in corresponding Japanese Patent Application No. 2008-506195, mailed on Mar. 22, 2011.
Official Communication issued in corresponding Chinese Patent Application 200780014133.2, mailed on Mar. 24, 2011.

* cited by examiner

PIEZOELECTRIC MICROPUMP

CROSS REFERENCE TO RELATED APPLICATIONS

The present application is a continuation of International Application No. PCT/JP2007/052323, filed Feb. 9, 2007, which claims priority to Japanese Patent Application No. JP2006-079424, filed Mar. 22, 2006, the entire contents of each of these applications being incorporated herein by reference in their entirety.

FIELD OF THE INVENTION

The present invention relates to piezoelectric micropumps, and more particularly to a micropump using a piezoelectric element which undergoes bending deformation.

BACKGROUND OF THE INVENTION

Hitherto, there has been known a micropump using a piezoelectric element which undergoes bending deformation in a bending mode by application of a voltage. Patent Document 1 discloses a micropump in which a pump chamber is formed in a pump body, and a piezoelectric element is attached onto a back surface of a diaphragm which defines a top wall of the pump chamber.

FIG. 9(*a*) schematically illustrates a pump structure described in Patent Document 1. A pump chamber 21 is provided in a case 20. A piezoelectric element 23 is attached onto a diaphragm 22 which defines a top wall of the pump chamber 21. The diaphragm 22 is formed of an organic material such as polyimide. However, referring to FIG. 9(*b*), when the piezoelectric element 23 undergoes bending deformation, a change in volume of the pump chamber 21, which is expected to be generated by bending of the piezoelectric element 23, partly becomes inefficient as a result of a displacement of the diaphragm 22 at both end portions of the piezoelectric element 23. In other words, the piezoelectric element 23 is merely moved in a floated manner via the diaphragm 22. Hence, a displacement of the piezoelectric element 23 cannot be transmitted as a change in volume of the pump chamber 21. This phenomenon occurs because, for example, when the piezoelectric element 23 is deformed to bulge toward the pump chamber 21 so as to pump out incompressible fluid (liquid) filled in the pump chamber 21, a pressure of the liquid is applied to the diaphragm 22, and a peripheral portion of the diaphragm 22 (portion where the piezoelectric element 23 is not attached) is displaced in a reverse direction away from the pump chamber 21 by the pressure of the liquid. In contrast, when the piezoelectric element 23 is deformed to bulge away from the pump chamber 21, the peripheral portion of the diaphragm 22 is bent toward the pump chamber 21.

When the diaphragm 22 is formed of a hard material such as a metal plate, bending of the peripheral portion of the diaphragm 22 can be inhibited, and hence, the phenomenon as shown in FIG. 9(*b*) does not occur. However, if the diaphragm 22 is hard, the diaphragm 22 inhibits the bending deformation of the piezoelectric element 23, thereby decreasing the amplitude of the bending deformation and the change in volume of the pump chamber 21. Also, a drive frequency of the pump is decreased, and hence, fluid transportation performance is deteriorated. Further, in the known configuration, unless the piezoelectric element 23 is attached to the center of the diaphragm 22, the left-right balance of a displacement is disrupted, and the change in volume of the pump chamber 21 cannot be correctly transmitted. Thus, it is necessary to increase a positional accuracy of attachment between the diaphragm 22 and the piezoelectric element 23.

Patent Document 1: Japanese Unexamined Patent Application Publication No. 2003-214349

SUMMARY OF THE INVENTION

Accordingly, an object of a preferred embodiment of the present invention is to provide a piezoelectric micropump capable of efficiently transmit a displacement of a piezoelectric element as a change in volume of a pump chamber even when a diaphragm is formed of a soft material, and having good fluid transportation performance.

To attain the above-mentioned object, the present invention provides a piezoelectric micropump, in which a pump chamber is isolated by a diaphragm, a piezoelectric element is disposed on a back surface of the diaphragm, the diaphragm is deformed by bending deformation of the piezoelectric element, and the volume of the pump chamber is changed, to transport fluid in the pump chamber. In the micropump, a support member is provided, the support member being in contact with a back surface of the piezoelectric element to support the piezoelectric element.

When an alternating voltage (rectangular wave voltage or alternating voltage) is applied to the piezoelectric element, the piezoelectric element undergoes bending deformation in a plate-thickness direction, and the diaphragm is deformed by the bending deformation. If the diaphragm is formed of a soft material, a peripheral portion of the diaphragm (portion where the piezoelectric element is not arranged) is bent in a reverse direction opposite to the piezoelectric element as a result of a change in pressure of the fluid filled in the pump chamber. Hence, as with the known micropump shown in FIGS. 9(*a*) and 9(*b*), the displacement of the piezoelectric element cannot be efficiently transmitted as the change in volume of the pump chamber. However, since in the present invention the back surface of the piezoelectric element is supported by the support member, the support member inhibits bending of the peripheral portion of the diaphragm in the reverse direction, and prevents the piezoelectric element from being floated. Accordingly, the displacement of the piezoelectric element can be reliably transmitted as the change in volume of the pump chamber, thereby enhancing the fluid transportation performance.

The back surface of the piezoelectric element is merely in contact with the support member, and restriction is not provided by the support member by bonding or the like. The support member does not inhibit the bending deformation of the piezoelectric element, and hence, the piezoelectric element can be efficiently driven. It is noted that the back surface of the diaphragm according to the present invention is a surface of the diaphragm opposite to the pump chamber, and the back surface of the piezoelectric element is a surface of the piezoelectric element opposite to the pump chamber.

It is preferable that the piezoelectric element be attached to a center portion of the diaphragm, however, in this embodiment, even if the diaphragm is shifted from the center portion, the support member inhibits a shift of the piezoelectric element toward the back surface of the piezoelectric element. Thus, the performance of the piezoelectric element is hardly deteriorated. In addition, the performance of the piezoelectric element is hardly deteriorated even when the diaphragm is markedly larger than the piezoelectric element. A soft diaphragm (with low Young's modulus) may be used, and a pumping action is likely to be obtained by a piezoelectric element driven with a low voltage.

The support member may be, for example, an inner wall of a case that supports the diaphragm, or may be an additional member disposed in the case. The support member may be formed of a relatively hard material similarly to the case, or may be formed of an elastic member such as rubber. The diaphragm may be formed of an organic material such as polyimide similarly to the known configuration. Alternatively, the diaphragm may be formed of any elastic material such as rubber or elastomer. Still alternatively, the diaphragm may be a metal plate. However, a soft elastic material having a Young's modulus of 20 MPa or smaller, and a thickness of 100 μm or smaller is desirable.

According to a preferable embodiment, the support member may be a flat member that supports an entire area of the back surface of the piezoelectric element in a non-drive state. In this case, the support member supports a back surface of an outer peripheral portion or back surfaces of both end portions of the piezoelectric element when the piezoelectric element is deformed to bulge toward the pump chamber, whereas the support member supports a back surface of a center portion of the piezoelectric element when the piezoelectric element is deformed to bulge away from the pump chamber. Accordingly, the diaphragm can be constantly displaced toward the pump chamber regardless of the direction the piezoelectric element is deformed, and hence, the volume of the pump chamber can be decreased. Accordingly, the fluid in the pump chamber can be reliably pumped out, and the fluid transportation performance can be enhanced.

According to a preferable embodiment, the piezoelectric element may be formed into a rectangular shape, the support member may support back surfaces of both end portions of the piezoelectric element in a longitudinal direction, and a space for the bending deformation of the piezoelectric element may be provided on a back-surface side of a center portion of the piezoelectric element. The shape of the piezoelectric element may be a circular shape or a rectangular shape. When a rectangular piezoelectric element undergoes bending displacement in a mode in which both end portions in the longitudinal direction (short two sides) of the piezoelectric element serve as supporting points, a larger volume displacement can be obtained, as compared with a case in which a circular piezoelectric element undergoes bending displacement in a mode in which an outer peripheral portion of the piezoelectric element serves as a supporting point. Hence, when the rectangular piezoelectric element is used as a diaphragm-drive actuator, a pumping efficiency can be enhanced. When the support member supports the entire area of the back surface of the piezoelectric element, the diaphragm can be constantly displaced toward the pump chamber regardless of the direction the piezoelectric element is deformed. However, the volume displacement of the pump chamber is smaller than a case in which the piezoelectric element is deformed to bulge away from the pump chamber. Hence, the support member supports the back surfaces of both end portions in the longitudinal direction of the piezoelectric element. Accordingly, the diaphragm is displaced such that the center portion thereof is pushed up when the piezoelectric element is deformed to bulge toward the pump chamber, whereas the diaphragm is displaced such that the center portion thereof is pulled down when the piezoelectric element is deformed to bulge away from the pump chamber. In either case, a large volume displacement can be obtained. Accordingly, the volume of the pump chamber can be periodically markedly varied, thereby enhancing the pumping efficiency.

According to a preferable embodiment, the piezoelectric element may be formed to be smaller than a displaceable region of the diaphragm, and the diaphragm may have a margin in a whole circumferential portion of the diaphragm located outside the piezoelectric element, the piezoelectric element being not arranged at the margin. When the piezoelectric element has a size equivalent to that of the displaceable region of the diaphragm, the diaphragm has almost no margin. Hence, when the piezoelectric element is displaced, an excessively large force is partly applied to the diaphragm; thereby the displacement of the piezoelectric element may be restricted. In contrast, when the piezoelectric element is smaller than the displaceable region of the diaphragm, and the diaphragm has the margin outside the piezoelectric element, the margin of the diaphragm can be freely expanded or contracted when the piezoelectric element is displaced. Thus, the displacement of the piezoelectric element is not restricted. Accordingly, the piezoelectric element may undergo bending displacement freely, and the pump efficiency can be enhanced.

According to a preferable embodiment, the piezoelectric element may be face-bonded onto the diaphragm. In this case, since the diaphragm is moved while the diaphragm is closely attached onto the piezoelectric element, the displacement of the piezoelectric element can be reliably transmitted to the diaphragm. In addition, the piezoelectric element can be prevented from freely moving in a left-right direction. An adhesive may be an elastic adhesive such as a silicone adhesive or a urethane adhesive. Even when the piezoelectric element is slightly shifted from the center portion of the diaphragm, the shift does not seriously affect the pumping efficiency.

According to a preferable embodiment, a gap between the diaphragm and the support member in a thickness direction may be smaller than a thickness of the piezoelectric element, and the piezoelectric element may be pressed to the support member by elasticity of the diaphragm. The piezoelectric element can be preliminarily pressed to the support member and held by the elasticity of the diaphragm. Since the piezoelectric element and the support member are in contact with each other securely, the volume of the pump chamber can be reliably changed by the bending deformation of the piezoelectric element. As described above, when the piezoelectric element is preliminarily pressed to the support member and held by the elasticity of the diaphragm, the piezoelectric element and the diaphragm do not have to be bonded to each other. When the piezoelectric element and the diaphragm are not bonded to each other, the piezoelectric element can be freely displaced without restriction by the diaphragm. Accordingly, the piezoelectric element can be efficiently driven with a low voltage. When the piezoelectric element and the diaphragm are not bonded to each other, the piezoelectric element may be shifted from the diaphragm in a plane direction. Thus, the support member may preferably have a peripheral wall portion that regulates the position of an outer peripheral surface of the piezoelectric element with a predetermined gap interposed therebetween. In this case, the piezoelectric element can be prevented from being shifted, and the peripheral wall portion does not restrict the displacement of the piezoelectric element. Thus, the piezoelectric element can be efficiently driven.

As described above, with the present invention, since the support member supports the back surface of the piezoelectric element, the support member inhibits a displacement of the peripheral portion of the diaphragm. The support member thus prevents the piezoelectric element from being floated. Accordingly, the displacement of the piezoelectric element can be reliably transmitted as the change in volume of the pump chamber, thereby enhancing the fluid transportation performance.

REFERENCE NUMERALS

Figure 1:
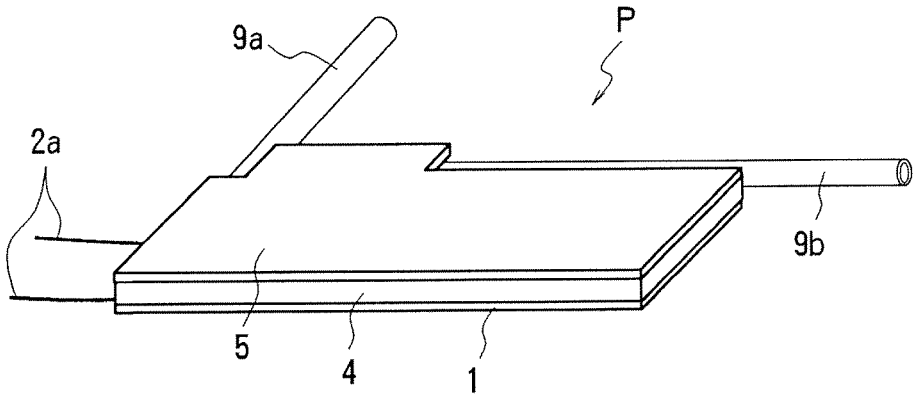
FIG. 1 is a perspective view showing a piezoelectric micropump according to a first embodiment of the present invention.

P micropump
1 bottom plate
1*a* recess (vibration chamber)
1$a_1$ bottom wall (support member)
1*d* block (support member)
2 piezoelectric element
3 diaphragm
3*a* margin
4 frame
5 top plate
6 pump chamber
7 intake passage
8 discharge passage
10,11 check valve

DETAILED DESCRIPTION OF THE INVENTION

Hereinafter, best modes of the present invention are described below with reference to embodiments.

First Embodiment

FIGS. 1 to 4 illustrate a piezoelectric micropump according to a first embodiment of the present invention. A micropump P of this embodiment includes a bottom plate 1, a piezoelectric element 2, a diaphragm 3, a frame 4, and a top plate 5. These components are mutually layered and bonded.

The bottom plate 1 is formed of, for example, a glass epoxy board or a resin material. A rectangular recess 1*a* serving as a vibration chamber is formed at a center portion of the bottom plate 1. In this embodiment, though described later, a bottom wall 1$a_1$ of the recess 1*a* serves as a support member. The bottom wall 1$a_1$ is in contact with a back surface of the piezoelectric element 2 and supports the piezoelectric element 2. Two ports 1*b* and a plurality of through holes 1*c* are formed at a bottom surface of the recess 1*a*. Leads 2*a* of the piezoelectric element 2 are led from the ports 1*b*. The through holes 1*c* cause the vibration chamber to be exposed to the air. The recess 1*a* has a depth equivalent to or slightly smaller than the thickness of the piezoelectric element 2.

The piezoelectric element 2 has a rectangular shape, and is housed in the recess 1*a*. The outside dimension of the piezoelectric element 2 is smaller than the inside dimension of the recess 1*a*. When the piezoelectric element 2 is housed in the recess 1*a*, predetermined gaps δ (see FIG. 3) are provided between four sides of the piezoelectric element 2 and inner edges of the recess 1*a*. The gaps δ correspond to widths of margins 3*a* of the diaphragm 3. The diaphragm 3 can be sufficiently expanded at the margins 3*a* when the piezoelectric element 2 undergoes bending deformation. The piezoelectric element 2 of this embodiment is a known bimorph-type ceramic piezoelectric element. The piezoelectric element 2 has electrodes at a lower surface thereof. The two leads 2*a* are connected to the electrodes. In response to application of a rectangular wave signal or an alternating current signal to the leads 2*a*, the piezoelectric element 2 is vibrated in a bending mode in which both end portions in a longitudinal direction (short two sides) of the piezoelectric element 2 serve as supporting points, and a center portion in the longitudinal direction thereof serves as a maximum displacement point. Alternatively, the piezoelectric element 2 may be a unimorph-type piezoelectric element.

The diaphragm 3 is formed of an elastic sheet material, such as rubber, elastomer, or soft resin. The diaphragm 3 has a shape equivalent to that of the bottom plate 1. An adhesive is applied onto an entire surface of a back surface, or a surface near the vibration chamber, of the diaphragm 3. When the diaphragm 3 is closely attached onto the bottom plate 1, in which the piezoelectric element 2 is housed, the diaphragm 3 is face-bonded onto the piezoelectric element 2, and is bonded onto an upper surface of the bottom plate 1 in an area not occupied by the recess 1*a*.

The frame 4 is formed of, for example, a glass epoxy board or a resin material. The frame 4 has a rectangular frame shape to define a pump chamber 6. A side wall portion 4*a* for forming an intake passage 7 is provided outside a surface of one of short sides of the frame 4. A side wall portion 4*b* for forming a discharge passage 8 is provided outside a surface of one of long sides of the frame 4. An intake port 4*c* is formed at a side wall between the inside of the frame 4 (pump chamber) and the intake passage 7. A check valve 10 is attached to a pump-chamber side of the intake port 4*c*. The check valve 10 only allows liquid to flow into the pump chamber 6. A discharge port 4*d* is formed at a side wall between the inside of the frame 4 (pump chamber) and the discharge passage 8. A check valve 11 is attached to a discharge-passage side of the discharge port 4*d*. The check valve 11 only allows liquid to be discharged from the pump chamber 6. In this embodiment, the check valves 10 and 11 are formed of an elastic sheet of, for example, rubber, however, it is not limited thereto. A lower surface of the frame 4 is bonded onto an upper surface of the diaphragm 3.

The top plate 5 is formed of, for example, a glass epoxy board or a resin material. The top plate 5 is bonded onto an upper surface of the frame 4. By bonding the top plate 5, the pump chamber 6, the intake passage 7, and the discharge passage 8 are defined between the top plate 5 and the diaphragm 3. Tubes 9*a* and 9*b* are respectively connected to the intake passage 7 and the discharge passage 8. The intake passage 7 and the discharge passage 8 are respectively connected to a liquid supply portion and a liquid discharge portion (not shown) via the tubes 9*a* and 9*b*. In this embodiment, the tubes 9*a* and 9*b* are silicon tubes.

Figure 5A:
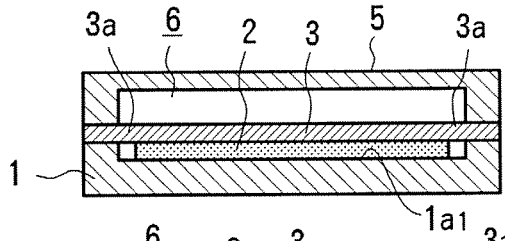
FIGS. 5(*a*), 5(*b*) and 5(*c*) are cross sections schematically showing an operation of the piezoelectric micropump in FIG. 1, FIG. 5(*a*) showing a non-drive state, FIG. 5(*b*) showing an upwardly bulging state, and FIG. 5(*c*) showing a downwardly bulging state.
Figure 5B:
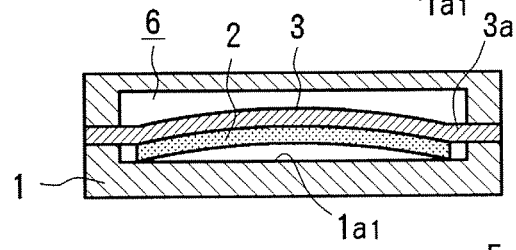
Figure 5C:
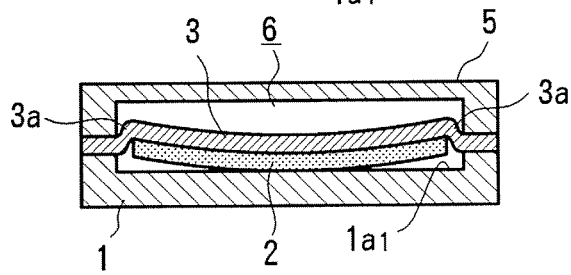

FIGS. 5(*a*) through 5(*c*) are schematic diagrams of an operation of the above-described micropump P. FIG. 5(*a*) illustrates a non-drive state or a voltage-switching state, FIG. 5(*b*) illustrates a state where the piezoelectric element 2 is deformed to bulge upwardly, and FIG. 5(*c*) illustrates a state where the piezoelectric element 2 is deformed to bulge downwardly.

Figure 6:
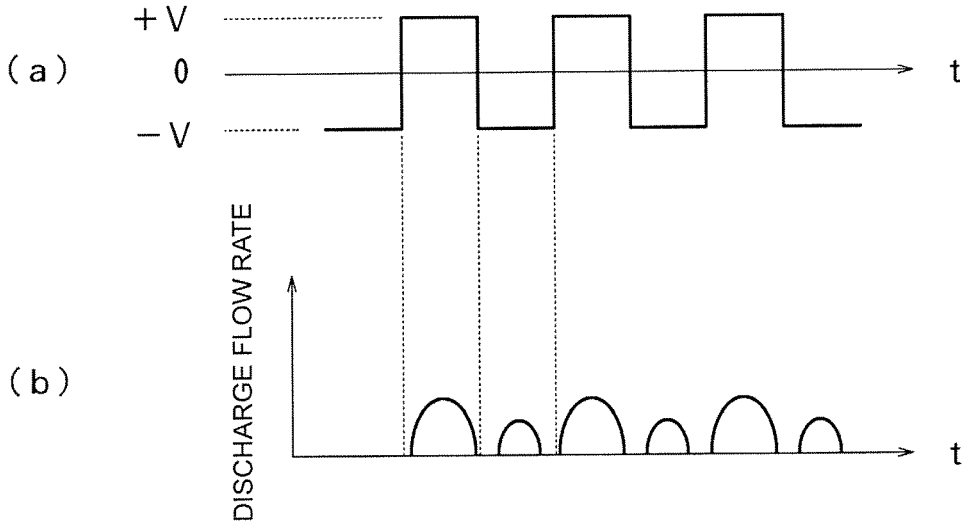
FIG. 6(*a*) illustrates an alternating current to be applied to the piezoelectric element, and FIG. 6(*b*) illustrates a change in discharge flow rate of the micropump.

FIG. 6(*a*) illustrates an alternating voltage applied to the piezoelectric element 2. When alternating voltages of +V and −V are alternately applied, for example, the piezoelectric element 2 is deformed to bulge upwardly in a half period of +V as shown in FIG. 5(*b*) whereas the piezoelectric element 2 is deformed to bulge downwardly in a half period of −V as shown in FIG. 5(*c*). When the voltage is switched, the piezoelectric element 2 is restored to a flat shape as shown in FIG. 5(*a*), and hence, the diaphragm 3 is restored to a flat shape. It is noted that the direction of the voltage and the direction of the deformation of the piezoelectric element 2 depend on the polarization direction of the piezoelectric element 2. Thus, the piezoelectric element 2 may be deformed to bulge downwardly in a half period of +V whereas the piezoelectric element 2 may be deformed to bulge upwardly in a half period of −V, in a reverse manner.

When the piezoelectric element 2 is deformed to bulge upwardly, a center portion of the diaphragm 3 is displaced toward the pump chamber 6, and the diaphragm 3 pumps out the liquid in the pump chamber 6. At this time, although the diaphragm 3 is pushed in a reverse direction by a pressure of the liquid in the pump chamber 6, since both end portions in the longitudinal direction of the piezoelectric element 2 are in contact with the bottom wall 1*a*, of the recess 1*a* of the bottom plate 1 and are supported by the bottom wall 1*a*, the diaphragm 3 is not bent in the reverse direction away from the pump chamber 6. Thus, the diaphragm 3 can efficiently pump out the liquid. Since the margins 3*a* having the widths δ are provided at the four sides of the diaphragm 3, when the piezoelectric element 2 is deformed to bulge upwardly, the margins 3*a* corresponding to both end portions in a short-side direction (two long sides) of the piezoelectric element 2 are expanded. Accordingly, the piezoelectric element 2 may undergo large bending deformation without the displacement of the piezoelectric element 2 being restricted. In contrast, when the piezoelectric element 2 is deformed to bulge downwardly, the center portion in the longitudinal direction of the piezoelectric element 2 is in contact with the bottom wall $\mathbf{1}a_1$ of the recess 1*a* of the bottom plate 1. Hence, both end portions of the piezoelectric element 2 are raised, a peripheral portion of the diaphragm 3 is displaced toward the pump chamber 6, and thus, the diaphragm 3 pumps out the liquid in the pump chamber 6. At this time, the margins 3*a* corresponding to both end portions in the longitudinal direction of the piezoelectric element 2 (two short sides) and the margins 3*a* corresponding to both end portions in the short-side direction of the piezoelectric element 2 (two long sides) are expanded. Accordingly, the piezoelectric element 2 may undergo bending deformation without the displacement of the piezoelectric element 2 being restricted.

FIG. 6(*b*) illustrates a change in discharge flow rate of the micropump P. As described above, since the piezoelectric element 2 constantly causes the diaphragm 3 to be displaced toward the pump chamber 6 regardless of the direction the piezoelectric element 2 is deformed, the liquid is discharged from the pump chamber 6 at short intervals, and hence, the liquid can be substantially continuously discharged from the pump chamber 6. The discharge flow rate when the piezoelectric element 2 is deformed to bulge upwardly is larger than the discharge flow rate when the piezoelectric element 2 is deformed to bulge downwardly. Accordingly, as shown in FIG. 6(*b*), discharge with a large flow rate and discharge with a small flow rate alternately appear.

In the micropump having the above-described configuration, when the size of the pump chamber 6 was 25.5 mm×12.5 mm×1.6 mm, and a rectangular wave voltage with ±5V at 17 Hz was applied to the piezoelectric element 2 to drive the piezoelectric element 2, a discharge flow rate of 6.4 μl/s and a pump pressure of 350 Pa were obtained.

Second Embodiment

Figure 7:
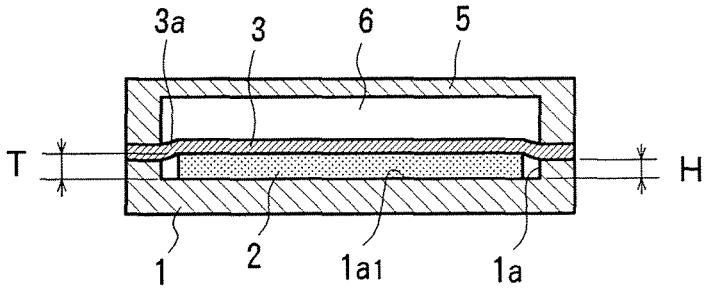
FIG. 7 is a schematic cross section according to a second embodiment of the present invention.

FIG. 7 illustrates a preferable second embodiment of the present invention. This embodiment is an example in which a gap H between the diaphragm 3 and the bottom wall $\mathbf{1}a_1$ of the recess of the bottom plate 1 according to the first embodiment is set smaller than a thickness T of the piezoelectric element 2. In this case, the piezoelectric element 2 can be pressed to the bottom wall 1*a* and held by the elasticity of the diaphragm 3. Hence, the piezoelectric element 2 and the diaphragm 3 do not have to be bonded to each other. However, the piezoelectric element 2 and the diaphragm 3 may be bonded to each other.

When the piezoelectric element 2 and the diaphragm 3 are not bonded to each other, the piezoelectric element 2 may undergo bending deformation more freely as compared with the case where both components are bonded to each other. Thus, a large displacement can be obtained. This can enhance a pumping efficiency.

Third Embodiment

Figure 8A:
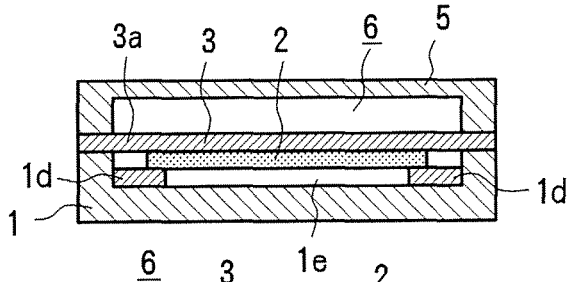
FIGS. 8(*a*), 8(*b*) and 8(*c*) are cross sections schematically showing a third embodiment of the present invention, FIG. 8(*a*) showing a non-drive state, FIG. 8(*b*) showing an upwardly bulging state, and FIG. 8(*c*) showing a downwardly bulging state.
Figure 8B:
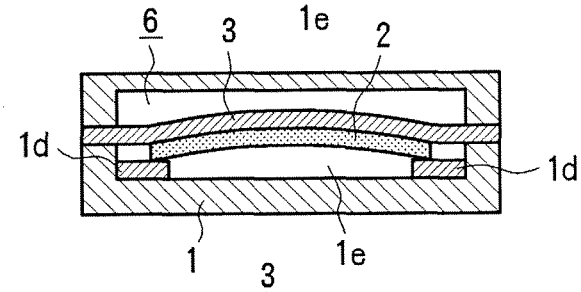
Figure 8C:
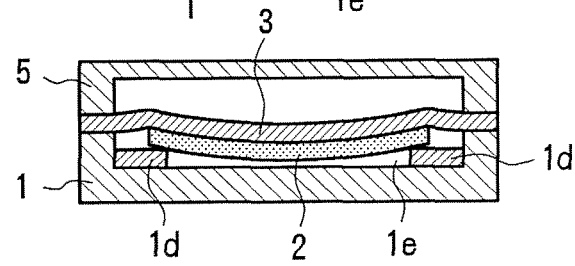
Figure 9A:
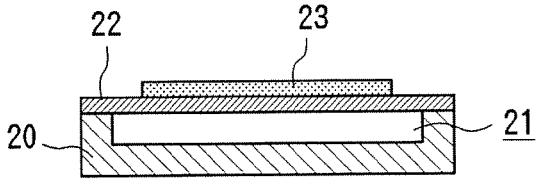
FIG. 9(a) Prior Art
FIGS. 9(*a*) and 9(*b*) are cross sections of an example of a known micropump, FIG. 9(*a*) showing a non-drive state, and FIG. 9(*b*) showing a state where a piezoelectric element is deformed.
Figure 9B:
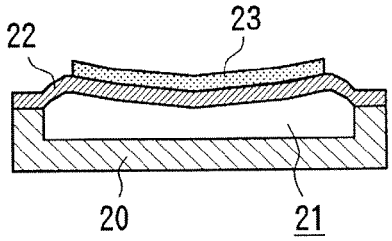
FIG. 9(b) Prior Art

FIGS. 8(*a*) through 8(*c*) illustrate a preferable third embodiment of the present invention. FIG. 8(*a*) illustrates a non-drive state or a voltage-switching state, FIG. 8(*b*) illustrates a state where the piezoelectric element 2 is deformed to bulge upwardly, and FIG. 8(*c*) illustrates a state where the piezoelectric element 2 is deformed to bulge downwardly.

In this embodiment, blocks (support members) 1*d* are provided at the recess 1*a* of the bottom plate 1. The blocks 1*d* support both end portions in the longitudinal direction, namely, two short sides of the piezoelectric element 2. The piezoelectric element 2 is merely placed on the blocks 1*d*, and is not bonded to the blocks 1*d*. The blocks 1*d* may be integrally formed with the bottom plate 1, or may be fixed onto the bottom plate 1 as additional members. A vibration space 1*e* is provided between the blocks 1*d*. The piezoelectric element 2 is freely deformable in the vibration space 1*e*.

As described above, both end portions in the longitudinal direction of the piezoelectric element 2 are supported by the blocks 1*d*, so that the piezoelectric element 2 is lifted in the vibration chamber. Accordingly, when the piezoelectric element 2 is deformed to bulge upwardly as shown in FIG. 8(*b*), the piezoelectric element 2 pushes up the diaphragm 3 at an almost center portion thereof to decrease the volume of the pump chamber 6. Thus, the liquid in the pump chamber 6 can be pumped out. In contrast, when the piezoelectric element 2 is deformed to bulge downwardly as shown in FIG. 8(*c*), the piezoelectric element 2 is displaced such that the diaphragm 3 is pulled down. Since the vibration space 1*e* is provided between the blocks 1*d*, a center portion of the piezoelectric element 2 can be markedly displaced downwardly. The diaphragm 3 is simultaneously displaced by the downward displacement of the piezoelectric element 2, so that the volume of the pump chamber 6 can be increased. Thus, the liquid can be sucked into the pump chamber 6.

In this embodiment, the liquid can be sucked into the pump chamber 6 when the piezoelectric element 2 is deformed to bulge downwardly, whereas the liquid in the pump chamber 6 can be discharged when the piezoelectric element 2 is deformed to bulge upwardly. When the piezoelectric element undergoes upward or downward bending displacement in a bending mode, the blocks 1*d* constantly support both end portions of the piezoelectric element 2. Hence, the piezoelectric element 2 is not floated, and the displacement of the piezoelectric element 2 can be effectively transmitted as a change in volume of the pump chamber 6. With such a micropump of this embodiment, unlike the first embodiment, the bending of the piezoelectric element 2 in the reverse direction away from the pump chamber 6 can be effectively utilized. Thus, the discharge flow rate of the pump can be increased, and the pumping efficiency can be enhanced.

In the above-described embodiments, the piezoelectric element 2 is a bimorph-type piezoelectric element. The piezoelectric element of this type undergoes bending displacement equivalently in both directions when an alternating voltage is applied. Alternatively, for example, a piezoelectric element capable of being markedly displaced only in a direction may be employed. In the first embodiment, the discharge rate depends on the deformation to bulge upwardly of the piezoelectric element 2. Hence, if a piezoelectric element capable of being largely displaced only upwardly is employed, the pumping efficiency can be enhanced. The piezoelectric element capable of being largely displaced only in a direction is obtained by a layer structure in which upper and lower layers are asymmetric to an intermediate layer. Alternatively, even with a layer structure in which upper and lower layers are symmetric, a piezoelectric element may be markedly displaced only in a direction if a positive voltage to be applied and a negative voltage to be applied are asymmetric and a large voltage is applied only to one of the upper and lower layers. Still alternatively, if both structures are combined, a further large displacement can be obtained.

In the above-described embodiments, the rectangular piezoelectric element is used. However, a square or circular piezoelectric element may be employed. It is noted that the rectangular piezoelectric element achieves a larger volume displacement than the square or circular piezoelectric element does. Thus, the rectangular piezoelectric element can realize a small, high-efficient micropump.

Figure 2:
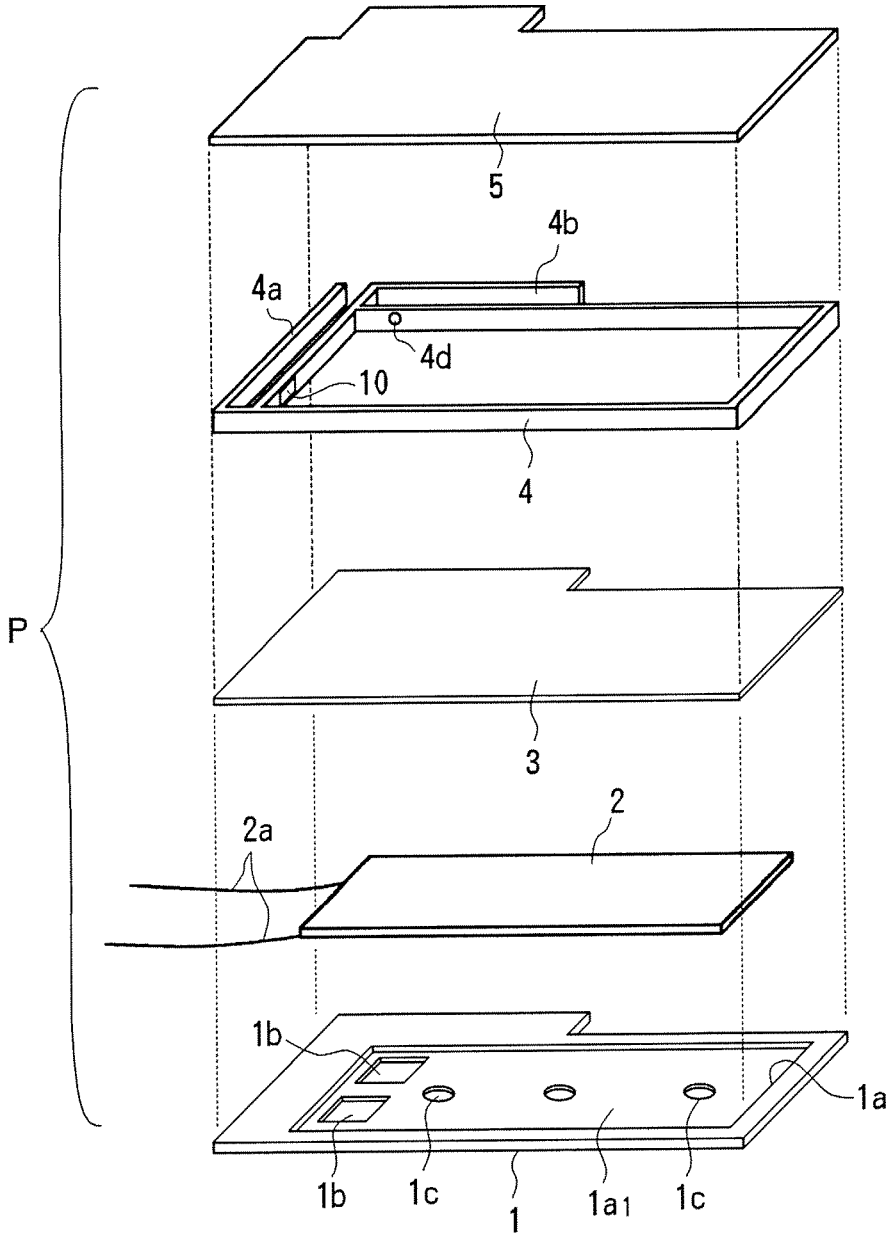
FIG. 2 is an exploded perspective view showing the piezoelectric micropump in FIG. 1.
Figure 3:
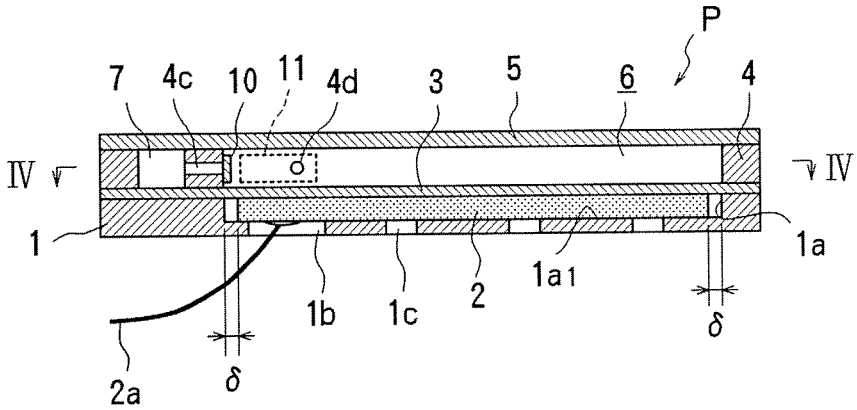
FIG. 3 is a longitudinal cross section showing the piezoelectric micropump in FIG. 1.
Figure 4:
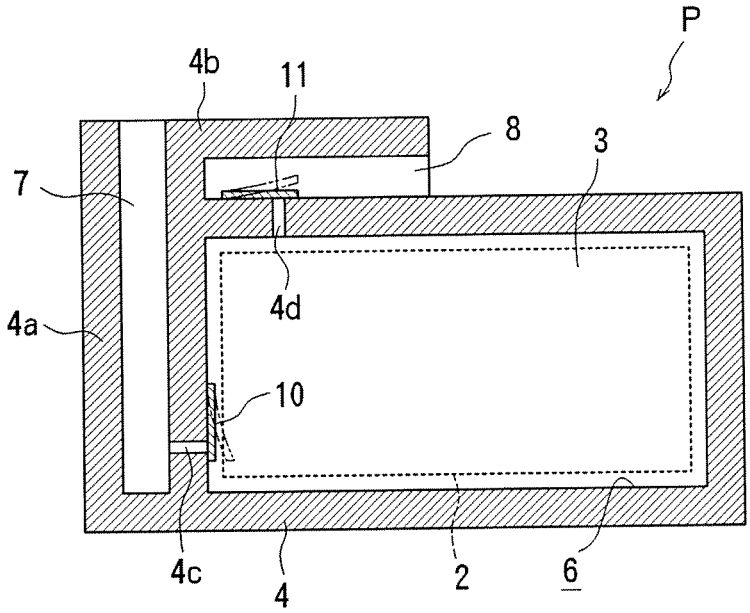
FIG. 4 is a cross section taken along line IV-IV in FIG. 3.

In the above-described embodiments, the bottom plate defining the case serves as the support member for supporting the back surface of the piezoelectric element. However, the support member may be an additional member which is separated from the case. In this case, the material of the support member is not limited to a hard material, and may be a soft material such as elastic rubber. Further, the case is not limited to one including the bottom plate, the frame, and the top plate as shown in FIG. 2. The case may have any structure as long as the pump chamber is isolated by the diaphragm, and the support member for supporting the back surface of the piezoelectric element may be provided.

The invention claimed is:

1. A piezoelectric micropump comprising:

a frame defining a pump chamber that includes an open end;

a diaphragm including a first surface covering the open end of the pump chamber and a second surface opposite the first surface, the diaphragm being made of a non-piezoelectric elastic sheet material;

a piezoelectric element including a first side disposed on the second surface of the diaphragm, and a second side opposite the first side, the piezoelectric element being arranged to undergo bending deformation in a thickness direction thereof when an alternating voltage is applied to the piezoelectric element, and the piezoelectric element being smaller than a displaceable region of the diaphragm; and a support member in contact with but not attached to the second side of the piezoelectric element; wherein the frame includes:

an intake port and a discharge port each extending through a side wall portion of the frame;

an intake port check valve arranged to only allow liquid to flow into the pump chamber via the intake port; and a discharge port check valve arranged to only allow liquid to be discharged from the pump chamber via the discharge port;

the piezoelectric element and the support member are arranged such that when the piezoelectric element is deformed to bulge toward the pump chamber, a central portion of the diaphragm is displaced toward the pump chamber and end portions of the diaphragm are prevented from bending in a reverse direction away from the pump chamber due to the contact between the second side of the piezoelectric element and the support member; and the diaphragm includes a margin at a circumferential portion of the diaphragm located outside of a location of the piezoelectric element.

2. The piezoelectric micropump according to claim 1, wherein the support member is a flat member that supports an entire area of the second side of the piezoelectric element in a non-drive state.

3. The piezoelectric micropump according to claim 1, wherein the piezoelectric element has a rectangular shape.

4. The piezoelectric micropump according to claim 3, wherein the support member is configured to support opposed longitudinal end portions of the piezoelectric element such that a space for bending deformation of the piezoelectric element is provided at a center portion of the second side of the piezoelectric element.

5. The piezoelectric micropump according to claim 1, wherein the piezoelectric element is bonded onto the second surface of the diaphragm.

6. The piezoelectric micropump according to claim 1, wherein a distance between a circumferential portion of the second surface of the diaphragm and the support member is smaller than a thickness of the piezoelectric element such that the piezoelectric element is pressed to the support member by the diaphragm.

* * * * *